US007003838B2

(12) United States Patent
Cunningham

(10) Patent No.: US 7,003,838 B2
(45) Date of Patent: Feb. 28, 2006

(54) HYDRAULIC PIG ADVANCE SYSTEM COMPRISING A CONTROL VOLUME CHAMBER CONTAINING HYDRAULIC FLUID AND A FORCE TRANSMITTING MEMBER

(75) Inventor: Michael Cunningham, Spring, TX (US)

(73) Assignee: Oceaneering International, Inc., Houston, TX (US)

( * ) Notice: Subject to any disclaimer, the term of this patent is extended or adjusted under 35 U.S.C. 154(b) by 39 days.

(21) Appl. No.: 10/403,773

(22) Filed: Mar. 31, 2003

(65) Prior Publication Data

US 2004/0187490 A1 Sep. 30, 2004

(51) Int. Cl.
*B08B 9/02* (2006.01)

(52) U.S. Cl. ..... 15/3.5; 417/392; 417/379; 417/391; 60/370; 134/8; 15/104.06; 15/104.062; 15/3.51

(58) Field of Classification Search ..... 417/391, 417/392, 379; 60/370; 15/3.5, 3.51, 104.062, 15/104.061
See application file for complete search history.

(56) References Cited

U.S. PATENT DOCUMENTS

| | | | | | |
|---|---|---|---|---|---|
| 3,322,140 | A * | 5/1967 | Scott | 137/268 |
| 3,779,270 | A * | 12/1973 | Davis | 137/268 |
| 4,069,535 | A * | 1/1978 | Cato | 15/104.061 |
| 4,509,222 | A * | 4/1985 | Knapp | 15/104.061 |
| 4,515,516 | A | 5/1985 | Perrine et al. | |
| 4,547,134 | A * | 10/1985 | Hirvonen | 417/349 |
| 4,741,673 | A * | 5/1988 | Jubb | 417/53 |
| 5,427,507 | A * | 6/1995 | Whitehead | 417/344 |
| 5,685,041 | A * | 11/1997 | Sivacoe | 15/104.061 |
| 5,899,272 | A * | 5/1999 | Loree | 166/280.2 |
| 6,596,089 | B1 * | 7/2003 | Smith et al. | 134/8 |
| 6,651,744 | B1 * | 11/2003 | Crawford | 166/311 |

* cited by examiner

*Primary Examiner*—Timothy S. Thorpe
*Assistant Examiner*—Emmanuel Sayoc
(74) *Attorney, Agent, or Firm*—Duane Morris LLP

(57) ABSTRACT

This invention relates to a hydraulic pig advance system comprising a control volume chamber containing hydraulic fluid and a force transmitting member. The system further comprises two directional control valves which can be selectively repositioned to cause hydraulic fluid to cycle the force transmitting member back and force such that in each cycle, a metered amount of hydraulic is transmitted into a pig housing where it causes a pig to move a predetermined distance.

16 Claims, 2 Drawing Sheets

HYDRAULIC PIG ADVANCE SYSTEM COMPRISING A CONTROL VOLUME CHAMBER CONTAINING HYDRAULIC FLUID AND A FORCE TRANSMITTING MEMBER

BACKGROUND OF THE INVENTION

1. Field of the Invention

This invention relates to a hydraulic pig advance system comprising a control volume chamber containing hydraulic fluid and a force transmitting member. The system further comprises two directional control valves which can be selectively repositioned to cause hydraulic fluid to cycle the force transmitting member back and force such that in each cycle, a metered amount of hydraulic is transmitted into a pig housing where it causes a pig to move a predetermined distance.

2. Description of the Prior Art

Pressurized accumulators have been used to use an injection burst of pressurized fluid to advance a pig in a process fluid line. The use of only a pressurized accumulators does not provide for precise control of the distance that the pig is advanced.

SUMMARY OF THE INVENTION

An apparatus embodiment of the present invention is directed toward a hydraulic pig advanced system comprising a control volume chamber having a first region and a second region. The chamber comprises hydraulic fluid. A first force transmitting member is moveably mounted in the chamber.

The invention further comprises a control volume chamber comprising a first region and a second region. The invention further comprises a first fluid line having a first end in communication with the first region of the chamber and a second end in fluid communication with the reservoir. The invention further comprises a second fluid line having a first end in fluid communication with the second region of the chamber and second end in fluid communication with the reservoir.

The invention further comprises a pig housing. The pig housing may also comprise a pig movably mounted in the housing. The invention further comprises a downstream flow path having first end in fluid communication with the housing, a second end in fluid communication with the first region of the chamber, and a third end in fluid communication with the second region of the chamber.

The invention further comprises a flow control device installed in the downstream flow path to selectively permit fluid flow from one of the first or second regions to the housing.

The present invention is also directed toward a method of advancing a pig in a pig housing. In the method of the present invention, hydraulic fluid is used to move a force transmitting member in a control volume from a first region of the control volume to a second region of the control volume. This movement of the force transmitting member causes a predetermined volume of hydraulic fluid to enter a pig housing, thereby causing a pig in the housing to move a predetermined distance.

DESCRIPTION OF THE PREFERRED EMBODIMENTS

Figure 1A:
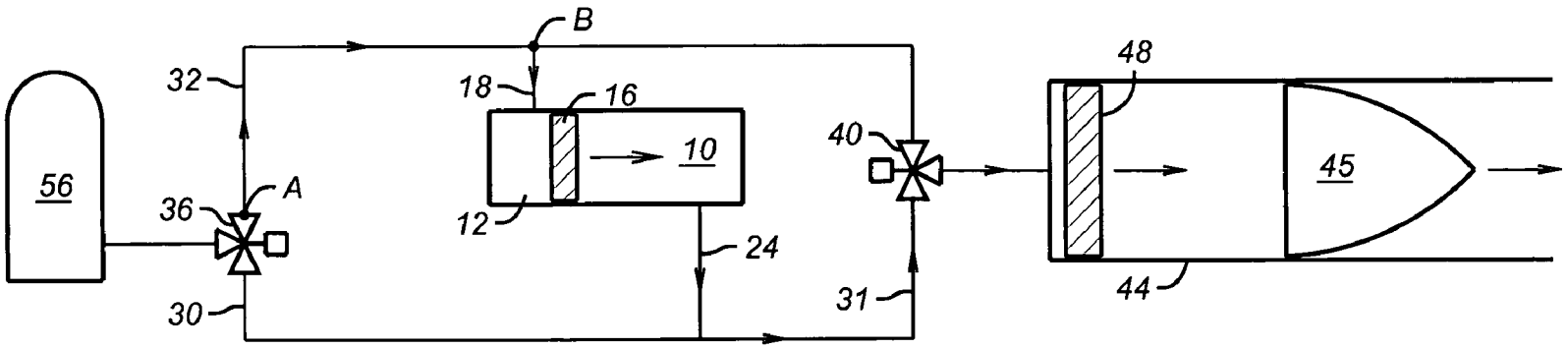
FIG. 1*a* is a flow diagram of the present invention depicting flow through the first fluid line and first loop section.
Figure 1B:
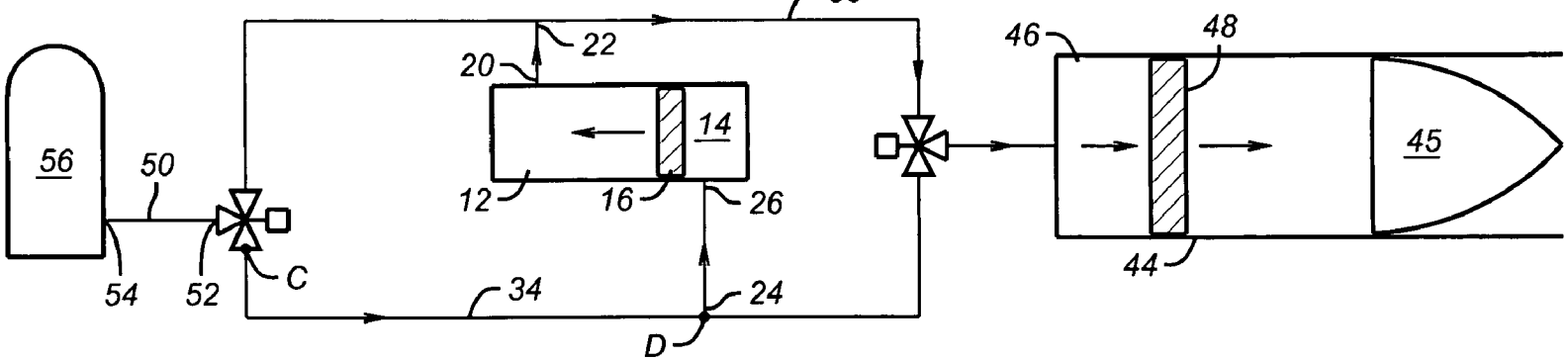
FIG. 1*b* is a flow diagram of the present invention depicting flow through the second fluid line and second loop section.

A preferred apparatus embodiment of the present invention comprises a control volume chamber 10 having a first region 12 and a second region 14, as shown in FIGS. 1*a* and 1*b*. The chamber comprises hydraulic fluid. A first force transmitting member 16 is moveably mounted in the chamber, as shown in FIGS. 1*a* and 1*b*. In a preferred embodiment, the control volume chamber is cylindrical and the first force transmitting member is round.

The invention further comprises a first fluid line 18 having a first end 20 in fluid communication with the first region of the chamber and a second end 22, as shown in FIG. 1*a*. Additionally, the invention comprises a second fluid line 24 having a first end 26 in fluid communication with the second region of the chamber and a second end 28, as shown in FIG. 1*b*.

The invention further comprises a fluid control loop 30 having a first loop section 32 in fluid communication with the second end of the first fluid line and a second loop section 34 in fluid communication with the second end of the second fluid line. The first loop section is that portion of control loop 30 extending from point A to point B as shown in FIG. 1*a*. The second loop section is that section of control loop 30 extending from point C to point D, as shown in FIG. 1*b*.

A first directional flow control device 36 is installed or positioned in the fluid receiving section so as to be capable of permitting fluid flow through the device 36 to the first loop section and the first fluid line or to the second loop section and second fluid line, depending upon the selective positioning of the first directional flow control device, as shown in FIGS. 1*a* and 1*b*.

A second directional flow control device 40 is installed or positioned in the fluid discharge section so as to be capable of permitting fluid through the device 40 from the first loop section and the first fluid line or from the second loop section and the second fluid line, depending upon the selective positioning of the second directional flow control device, as shown in FIGS. 1*a* and 1*b*. In one preferred embodiment, the first and second directional flow control devices are three way valves, each comprising three moveable valve members. In another preferred embodiment, the first and second directional control valves are hydraulically operated.

The invention further comprises a pig housing 44 having a first end 46 in fluid communication with the second directional flow control device such that fluid can flow from the control volume through the control loop and the second directional flow control device into the housing, as shown in FIGS. 1*a* and 1*b*.

In a preferred embodiment, the invention further comprises a second force transmitting member 48 which is moveably mounted in the housing such that the injection of fluid through the second directional flow control device into the housing will cause the second force transmitting member to move away from the first end of the housing, as shown in FIGS. 1*a* and 1*b*. The will result in displacement of the pig. In another preferred embodiment, the invention further comprises a pig 45 mounted in the pig housing, downstream of, and in fluid communication with, the second force transmitting member. In another preferred embodiment, the pressure resulting from the ejection of fluid into the pig housing can cause the pig to move a preselected distance.

In a preferred embodiment, the invention further comprises a fluid injection line 50 having a first end 52 and fluid communication with the first direction control valve. The fluid injection line further comprises a second end 54, as shown in FIG. 1*b*. In this preferred embodiment, the invention further comprises a pressurized source of hydraulic fluid, such as an accumulator 56 comprising hydraulic fluid, as shown in FIGS. 1*a* and 1*b*. The accumulator is in fluid communication with the second end of the fluid injection line.

The present invention is also directed toward a method of advancing a pig in a pig housing. A first preferred embodiment of this method comprises selectively positioning a first directional flow control device and second directional flow control device to form a first flow path from the first directional control device, through a first loop section of a fluid control loop to a second fluid line, into a first region of a control volume, as shown in FIG. 1*a*. In a preferred embodiment, the positioning is performed with a control valve.

This preferred method embodiment of the present invention further comprises injecting a metered volume of hydraulic fluid through the first flow path to cause a first force transmitting member located in a first location in the control volume to move to a second location in the control volume, as shown by the arrow in control volume 10 in FIG. 1*a*. The movement of the first force transmitting member results in an ejection of a metered volume of fluid from the control volume into a flow path comprising a first downstream loop section 31 of the control loop, the second directional flow control device, and then into a pig housing. This fluid movement causes a second force transmitting member located in the housing to advance a preselected distance in said housing thereby causing a pig located in the housing downstream of the second force transmitting member to advance a preselected distance, as shown in FIG. 1*a*.

Another preferred method embodiment of the present invention provides for repositioning the directional flow control devices to permit reverse flow that also results in displacement of the pig located in the pig housing. In this preferred embodiment, the method of the present invention further comprises selectively positioning the first directional flow control device and the second directional flow control device to form a second flow path from the first directional flow control device through a second loop of the fluid control loop to a second fluid line and into a second region of the control volume, as shown in FIG. 1*b*.

This preferred method embodiment of the invention further comprises injecting a metered volume of hydraulic fluid through the second flow path to cause the first force transmitting member located in the second location of the control volume to move back into the first location of the control volume, thereby ejecting the metered volume of fluid from the control volume into a flow path comprising a second downstream loop section 33 of the control loop, the second directional flow control device, and then into a pig housing to cause the second force transmitting member located in the housing to advance a preselected distance in the housing. This movement of the second face transmitting member causes the pig located in the housing downstream of the second force transmitting member to advance a preselected distance.

In a preferred embodiment, the selective positioning of the present method invention involves the selective positioning of three way valves. In a preferred embodiment, this selective positioning is accomplished by actuating a hydraulically operated first directional control valve.

Figure 2:
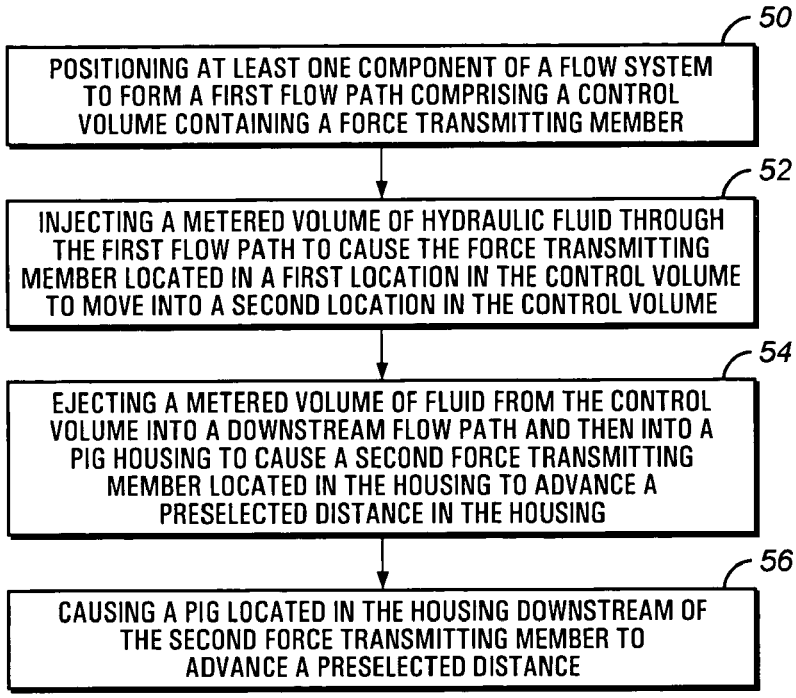
FIG. 2 is a block diagram of a first method embodiment of the present invention.

Another method embodiment of the present invention is depicted in the block diagram shown in FIG. 2. This embodiment comprises positioning at least one component of a flow system to form a first flow path comprising a control volume containing a force transmitting member, as shown in block 50 of FIG. 2. This method further comprises injecting a metered volume of hydraulic fluid through the first flow path to cause the force transmitting member located in a first location in the control volume to move into a second location in the control volume as shown in block 52 of FIG. 2. This method further comprises ejecting a metered volume of fluid from the control volume into a downstream flow path and then into a pig housing to cause a second force transmitting member located in the housing to advance a preselected distance in the housing, as shown in block 54 of FIG. 2. This method further comprises causing a pig located in the housing downstream of the second force transmitting member to advance a preselected distance, as shown in block 56 of FIG. 2.

Figure 3:
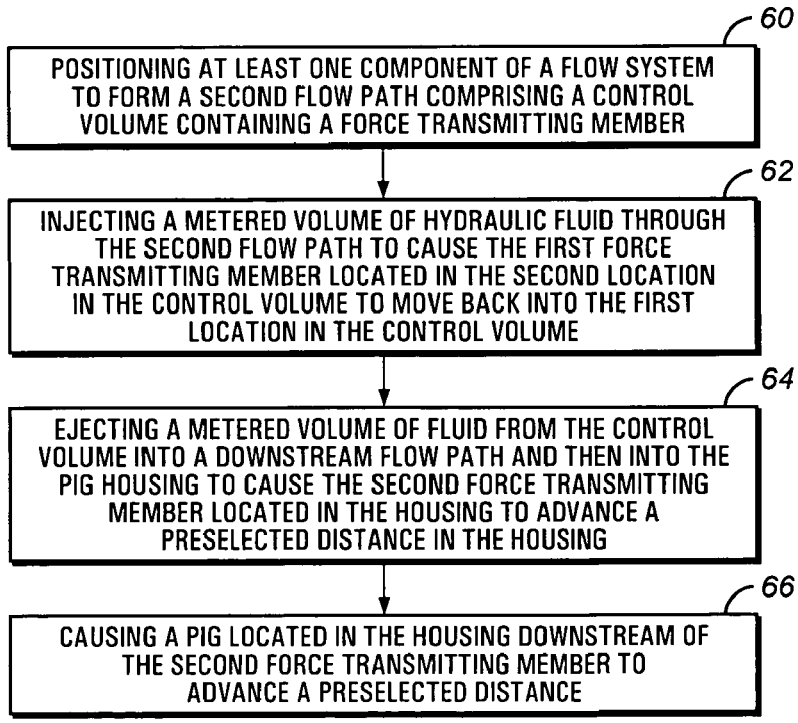
FIG. 3 is a block diagram of a second method embodiment of the present invention.

Another preferred method embodiment of the present invention comprises all the steps shown in FIG. 2, plus the additional step of positioning at least one component of a flow system to form a second flow path comprising a control volume containing a force transmitting member as shown in block 60 of FIG. 3. This preferred method embodiment further comprises injecting a metered volume of hydraulic fluid through the second flow path to cause the first force transmitting member located in the second location in the control volume to move back into the first location in the control volume, as shown in block 62 of FIG. 3. This preferred method embodiment further comprises ejecting a metered volume of fluid from the control volume into a downstream flowpath and then into the pig housing to cause the second force transmitting member located in the housing to advance a preselected distance in the housing, as shown in block 64 of FIG. 3. This preferred method embodiment further comprises causing the pig located in the housing downstream of the second force transmitting member to advance a preselected distance, as shown in block 66 of FIG. 3.

The foregoing disclosure and description of the invention are illustrative and explanatory. Various changes in the size, shape, and materials, as well as in the details of the illustrative construction may be made without departing from the spirit of the invention.

What is claimed is:

1. A hydraulic pig advance system comprising:

a control volume chamber having a first region and a second region, said chamber comprising hydraulic fluid;

a first force transmitting member moveably mounted in said chamber;

a first fluid line having a first end in fluid communication with the first region of said chamber and a second end;

a second fluid line having a first end in fluid communication with the second region of said chamber and a second end;

a fluid control loop having a first loop section in fluid communication with the second end of said first fluid line, said first loop section being distinct from said first fluid line, and a second loop section in fluid communication with the second end of said second fluid line said second loop section being distinct from said second fluid line;

a first directional flow control device positioned in said fluid control loop intermediate said first loop section and said second loop section so as to be capable of permitting fluid flow through said first directional flow control device to said first loop section and said first fluid line or to said second loop section and said second fluid line, depending upon the selective positioning of said first directional flow control device;

a second directional flow control device positioned in a fluid discharge section, said fluid discharge section being separate from but in fluid communication with said fluid control loop, so as to be capable of permitting fluid flow through said second directional flow control device from said first loop section and said first fluid line or from said second loop section and said second fluid line, depending upon the selective positioning of said second directional flow control device; and a pig housing having a first end in fluid communication with said second directional control valve such that fluid can flow from said control volume, through at least one of said first loop section or said section loop section and said second directional control valve into said housing.

2. The system of claim 1, further comprising a second force transmitting member moveably mounted in said housing, such that the injection of fluid through said second directional flow control device and into said housing will cause said second force transmitting member to move away from said first end of said housing.

3. The system of claim 1, further comprising:

a fluid injection line having a first end in fluid communication with the first directional flow control device, and further having a second end; and an accumulator comprising hydraulic fluid, said accumulator being in fluid communication with the second end of the fluid injection line.

4. The system of claim 1, wherein said first and second directional flow control devices are three way valves.

5. The system of claim 1, further comprising a pig mounted in said pig housing downstream of, and in fluid communication with, said second force transmitting member.

6. The system of claim 4, wherein said first and second directional control valves are hydraulically operated.

7. The system of claim 1, further comprising a pressurized source of hydraulic fluid in fluid communication with said first directional control valve.

8. A hydraulic pig advance system comprising:

a hydraulic fluid reservoir;

a control volume chamber comprising a first region and a second region;

a first force transmitting member moveably mounted in said chamber;

a first fluid line having a first end in fluid communication with the first region of the chamber and a second end in fluid communication with the reservoir;

a second fluid line having a first end in fluid communication with the second region of the chamber and a second end in fluid communication with the reservoir;

a pig housing;

a downstream flow path having a first end in fluid communication with the housing, a second end in fluid communication with the first region of the chamber, and a third end in fluid communication with the second region of the chamber; and a flow control device installed in the downstream flow path to selectively permit fluid flow from one of the first or the second regions to the housing.

9. The system of claim 8, wherein said flow control device is a directional control valve.

10. The system of claim 8, further comprising a second force transmitting member moveably mounted in said housing, such that the injection of fluid through said second directional control valve and into said housing will cause said second force transmitting member to move away from said first end of said housing.

11. The system of claim 8, further comprising a pig moveably mounted in the housing.

12. A hydraulic pig advance system comprising:

a control volume chamber having a first region and a second region, said chamber comprising hydraulic fluid;

a first force transmitting member moveably mounted in said chamber;

a first fluid line having a first end in fluid communication with the first region of said chamber and a second end;

a second fluid line having a first end in fluid communication with the second region of said chamber and a second end;

a fluid control loop having a first loop section in fluid communication with the second end of said first fluid line, and a second loop section in fluid communication with the second end of said second fluid line;

a first directional control valve comprising three moveable valve members, said valve being installed in said fluid control loop so as to be capable of permitting fluid flow through said valve to said first loop section and said first fluid line or to said second loop section and said second fluid line, depending upon the selective positioning of said valve members;

a second directional control valve comprising three moveable valve members, said valve being installed in said fluid discharge section so as to be capable of permitting fluid flow through said valve from said first loop section and said first fluid line or from said second loop section and said second fluid line, depending upon the selective positioning of said valve members;

a pig housing having a first end in fluid communication with said second directional control valve such that fluid can flow from said control volume, through at least one of said first loop section or said section loop section and said second directional control valve into said housing;

a second force transmitting member moveably mounted in said housing, such that the injection of fluid through said second directional control valve and into said housing will cause said second force transmitting member to move away from said first end of said housing; and a pressurized source of hydraulic fluid in fluid communication with said first directional control valve.

13. The system of claim 12, further comprising a pig mounted in said pig housing downstream of, and in fluid communication with, said second force transmitting member.

14. The system of claim 12, wherein said control volume is cylindrical and said first face transmitting member is round.

15. The system of claim 12, wherein said first and second directional control valves are three way valves.

16. The system of claim 12, wherein said first and second directional control valves are hydraulically operated.

* * * * *